US010294535B2

(12) United States Patent
Yaso

(10) Patent No.: US 10,294,535 B2
(45) Date of Patent: May 21, 2019

(54) ROTARY HEARTH FURNACE

(71) Applicant: Kobe Steel, Ltd., Kobe-shi (JP)

(72) Inventor: Tadashi Yaso, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 179 days.

(21) Appl. No.: 15/324,087

(22) PCT Filed: Jun. 23, 2015

(86) PCT No.: PCT/JP2015/068107
§ 371 (c)(1),
(2) Date: Jan. 5, 2017

(87) PCT Pub. No.: WO2016/009797
PCT Pub. Date: Jan. 21, 2016

(65) Prior Publication Data

US 2017/0198365 A1 Jul. 13, 2017

(30) Foreign Application Priority Data

Jul. 16, 2014 (JP) ..... 2014-146141

(51) Int. Cl.
*C21B 13/10* (2006.01)
*F27B 3/04* (2006.01)
(Continued)

(52) U.S. Cl.
CPC ..... *C21B 13/105* (2013.01); *C21B 13/10* (2013.01); *F27B 3/04* (2013.01); *F27B 3/06* (2013.01);
(Continued)

(58) Field of Classification Search
CPC ..... C21B 13/105; F27D 15/00
See application file for complete search history.

(56) References Cited

U.S. PATENT DOCUMENTS 3,836,320 A 9/1974 Hemsath et al.
6,368,379 B1 4/2002 Tateishi et al.
(Continued)

FOREIGN PATENT DOCUMENTS

| | | | |
|---|---|---|---|
| CN | 1928478 | A | 3/2007 |
| JP | 57-76123 | A | 5/1982 |
| JP | 58-67813 | A | 4/1983 |
| JP | 2001-181721 | A | 7/2001 |
| JP | 2004-315910 | A | 11/2004 |
| JP | 2009-256746 | A | 11/2009 |

OTHER PUBLICATIONS

Extended European Search Report dated Nov. 9, 2017 in Patent Application No. 15821445.2.
(Continued)

*Primary Examiner* — Scott R Kastler
(74) *Attorney, Agent, or Firm* — Oblon, McClelland, Maier & Neustadt, L.L.P.

(57) ABSTRACT

A rotary hearth furnace includes a unit that supplies an agglomerate onto a hearth of the rotary hearth furnace, a unit that discharges a heated substance which has been heated in the rotary hearth furnace to the outside of the furnace, and a unit that discharges an exhaust gas in the rotary hearth furnace to the outside of the furnace. The rotary hearth furnace has a heating section and a non-heating section. The unit that discharges an exhaust gas to the outside of the furnace is provided in the non-heating section. A unit that takes an outside air into the furnace is provided in the non-heating section and on an upstream side in a flow direction of the exhaust gas from the unit that discharges exhaust gas to the outside of the furnace.

8 Claims, 2 Drawing Sheets

(51) Int. Cl.

| | |
|---|---|
| ***F27B 3/06*** | (2006.01) |
| ***F27B 3/16*** | (2006.01) |
| ***F27B 3/18*** | (2006.01) |
| ***F27B 3/19*** | (2006.01) |
| ***F27B 3/22*** | (2006.01) |
| ***F27D 3/00*** | (2006.01) |
| ***F27D 15/00*** | (2006.01) |
| ***F27D 17/00*** | (2006.01) |
| ***F27B 9/16*** | (2006.01) |

(52) U.S. Cl.
CPC ..... *F27B 3/16* (2013.01); *F27B 3/18* (2013.01); *F27B 3/19* (2013.01); *F27B 3/22* (2013.01); *F27B 9/16* (2013.01); *F27D 3/0033* (2013.01); *F27D 15/00* (2013.01); *F27D 17/001* (2013.01)

(56) References Cited

U.S. PATENT DOCUMENTS

| | | | | |
|---|---|---|---|---|
| 2007/0034055 | A1 | 2/2007 | Tokuda et al. | |
| 2010/0031776 | A1* | 2/2010 | Englund | C21B 13/0073 75/392 |
| 2012/0007292 | A1 | 1/2012 | Tokuda et al. | |
| 2017/0198365 | A1* | 7/2017 | Yaso | C21B 13/10 |

OTHER PUBLICATIONS

International Search Report dated Aug. 11, 2015 in PCT/JP2015/068107 (with English translation).
Written Opinion of the International Searching Authority dated Aug. 11, 2015 in PCT/JP2015/068107 filed Jun. 23, 2015 (with English translation).

* cited by examiner

Prior Art

ROTARY HEARTH FURNACE

TECHNICAL FIELD

The present invention relates to a rotary hearth furnace. More specifically, the present invention relates to a rotary hearth furnace to be used for heating an agglomerate including an iron-oxide containing material such as an iron ore, iron-making dust, etc., and a carbonaceous reducing material such as a charcoal material, etc., to thereby reduce iron oxide and produce reduced iron.

BACKGROUND ART

As a method for reducing iron oxide contained in an iron-oxide containing material such as an iron ore to thereby produce reduced iron, attention has been paid to a reduced iron production process in which a comparatively easily available charcoal material such as coal is used as a carbonaceous reducing material for reducing iron oxide. In the reduced iron production process, an agglomerate including an iron-oxide containing material and a carbonaceous reducing material is supplied onto a hearth of a rotary hearth furnace, and the agglomerate is heated due to gas heat transfer and radiant heat by a heating burner provided in a heating section inside the rotary hearth, so as to reduce iron oxide and produce reduced iron. After that, heated substances are cooled when they are passing through a non-heating section inside the rotary hearth furnace, and are then discharged to the outside of the furnace. The heated substances discharged to the outside of the furnace are, for example, classified into magnetically attracted substances and non-magnetically attracted substances by a magnetic separator. The magnetically attracted substances are recovered as an iron source.

In the aforementioned reduced iron production process, exhaust gas is generated by combustion in the heating burner. When the concentration of oxidizing gas such as carbon dioxide, moisture, etc., in the exhaust gas is increased, the reducing rate of iron oxide cannot be increased satisfactorily. Therefore, in the rotary hearth furnace exhaust ports etc., are provided at suitable places so that the exhaust gas inside the furnace can be discharged to the outside of the furnace. However, a means for supplying an agglomerate onto the hearth of the rotary hearth furnace, a means for discharging heated substances which have been heated in the rotary hearth furnace to the outside of the furnace, etc. communicate with the outside of the furnace directly. Therefore, when the exhaust gas inside the furnace is sucked and discharged to the outside of the furnace, outside air may flow into the furnace from the outside of the furnace accordingly. The outside air flowing in contains oxidizing gas such as oxygen, causing reduction in the reducing rate of reduced iron.

Patent Literature 1 has proposed a method for producing reduced iron, in which a flow of in-furnace gas is controlled properly to prevent oxidizing gas from inhibiting reduction. The method for producing reduced iron performs sequentially in a moving direction of a hearth: a starting material supplying step of charging a starting material including a carbonaceous reducing material and an iron-oxide containing material into a rotary hearth furnace, a step of heating/reducing step of heating the starting material and reducing iron oxide in the starting material to thereby produce reduced iron, a melting step of melting the reduced iron, a cooling step of cooling the melted reduced iron, and a discharging step of discharging the cooled reduced iron to the outside of the furnace. In the method for producing reduced iron, a flow rate adjusting partition wall for controlling a flow of in-furnace gas is provided in the furnace so that the flow of the in-furnace gas in the cooling step can be formed in a moving direction of a hearth. In addition, the aforementioned literature also suggests that the flow rate adjusting partition wall for controlling the flow of the in-furnace gas is provided in the furnace so that the pressure of the in-furnace gas in the melting step can be made higher than the pressure of the in-furnace gas in any other step.

CITATION LIST

Patent Literature

Patent Literature 1: JP-A-2004-315910

SUMMARY OF THE INVENTION

Problem That the Invention is to Solve

In the aforementioned Patent Literature 1, the flow rate adjusting partition wall is provided to control the flow of the in-furnace gas. However, in order to control the direction of the flow of the in-furnace gas while reducing the volume of gas flowing in the furnace, it is necessary to make the gap between the flow rate adjusting partition wall and the hearth as small as possible to thereby increase the flow velocity of the gas passing through the gap. However, when heated substances that have not been discharged to the outside of the furnace have been accumulated on the hearth or when parts of refractories protecting the furnace have fallen down on the hearth, a bulky load may be formed on the hearth. There has been a fear that the load on the hearth does not pass through the gap between the flow rate adjusting partition wall and the hearth but may clog up the gap.

When the aforementioned agglomerate is heated in a heating section inside the rotary hearth furnace, it is recommended to oppose the direction of the flow of exhaust gas inside the furnace to the moving direction of the agglomerate. The exhaust gas inside the furnace has sensible heat. Therefore, when the direction of the flow of the exhaust gas is opposed to the moving direction of the agglomerate, the efficiency of contact between the agglomerate and the exhaust gas is enhanced so that the agglomerate can be heated by the sensible heat of the exhaust gas. Thus, the productivity of reduced iron can be improved. However, in the aforementioned Patent Literature 1, there has been no attention to the relationship between the moving direction of the agglomerate in the heating section and the direction of the flow of the in-furnace gas. Therefore, there has been a room for improvement.

The present invention has been developed paying attention to the aforementioned situation and an object thereof is to provide a rotary hearth furnace capable of effectively using sensible heat of exhaust gas in the furnace to thereby improve productivity of reduced iron.

Means For Solving the Problem

A rotary hearth furnace according to the present invention capable of solving the foregoing problem is a rotary hearth furnace serving for heating an agglomerate, the agglomerate including an iron-oxide containing material and a carbonaceous reducing material, and for reducing an iron oxide to thereby produce a reduced iron, the rotary hearth furnace including: a means for supplying the agglomerate onto a hearth of the rotary hearth furnace; a means for discharging a heated substance which has been heated in the rotary hearth furnace to the outside of the furnace; and a means for discharging an exhaust gas in the rotary hearth furnace to the outside of the furnace, and having a heating section and a non-heating section, in which: the means for discharging an exhaust gas to the outside of the furnace is provided in the non-heating section; and a means for taking an outside air into the furnace is provided in the non-heating section and on an upstream side in a flow direction of the exhaust gas from the means for discharging exhaust gas to the outside of the furnace.

It is preferable that the means for taking an outside air into the furnace includes a regulating valve that regulates the volume of a gas taken in. In addition, the means for taking an outside air into the furnace may include a blower. The rotary hearth furnace may further include a partition wall that partitions the heating section and the non-heating section.

Advantage of the Invention

In the rotary hearth furnace according to the present invention, the means for discharging an exhaust gas in the furnace to the outside of the furnace is provided in the non-heating section within the rotary hearth. In addition, the means for taking outside air into the furnace is provided in the non-heating section and on the upstream side of the means for discharging an exhaust gas to the outside of the furnace. As a result, the moving direction of the agglomerate in the heating section can be opposed to the flow direction of the exhaust gas in the furnace. Thus, the agglomerate can be heated by sensible heat of the exhaust gas, so that the productivity of reduced iron can be improved.

MODE FOR CARRYING OUT THE INVENTION

The present inventor has made in-depth examinations to effectively use sensible heat of exhaust gas in a furnace to thereby improve productivity of reduced iron when an agglomerate including an iron-oxide containing material and a carbonaceous reducing material is heated to reduce iron oxide to thereby produce reduced iron. As a result, the present inventor has found out that when a means for discharging exhaust gas in a rotary hearth furnace to the outside of the furnace is provided in a non-heating section inside the rotary hearth furnace and a means for taking outside air from the outside of the furnace into the furnace is provided in the non-heating section and on the upstream side of the means for discharging exhaust gas in the furnace to the outside of the furnace, the moving direction of the agglomerate in a heating section inside the rotary hearth furnace can be opposed to the flow direction of the exhaust gas inside the furnace to thereby increase the productivity of reduced iron. The present invention has been thereby completed.

The present invention will be described below specifically with reference to the drawings. The present invention is not restricted by the drawings, but it is a matter of course that changes can be made on the present invention to carry out it as long as the changes can meet the gist thereof which has been described previously and will be described later. Those changes are also encompassed in the technical scope of the present invention.

Figure 1:
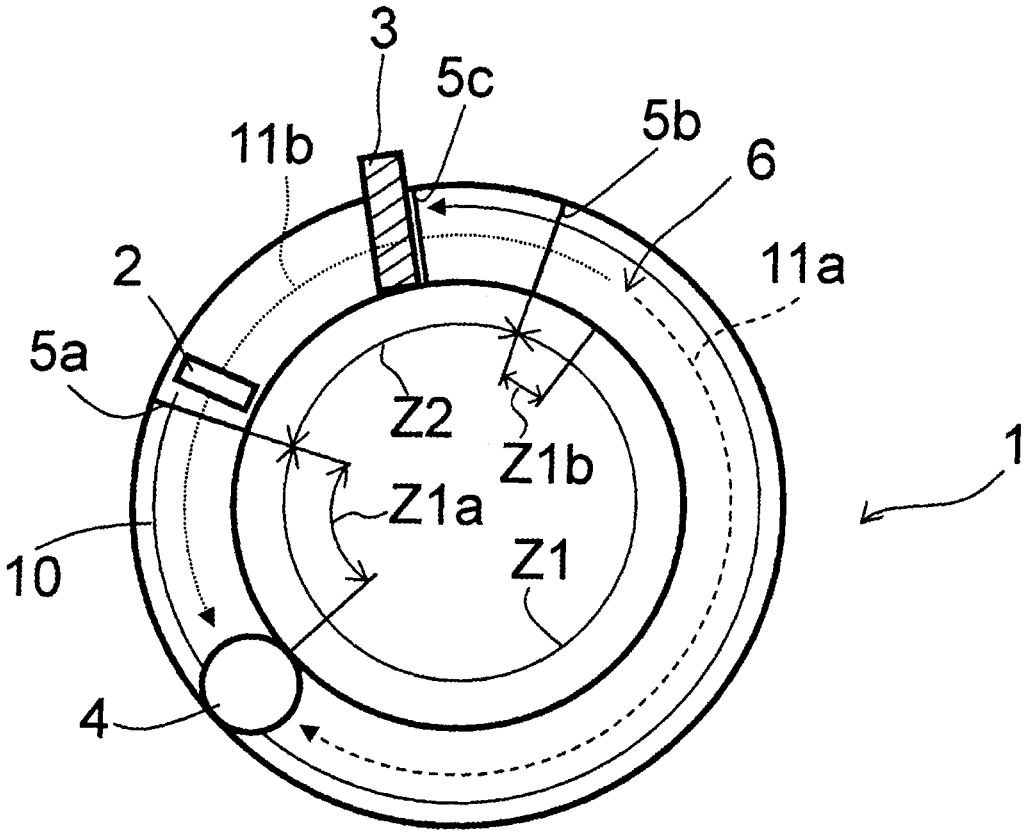
FIG. 1 is a schematic view for explaining a conventional rotary hearth furnace.

First, the structure of a rotary hearth furnace conventionally known will be described with reference to FIG. 1. FIG. 1 is a simplified view illustrating the rotary hearth furnace disclosed in the aforementioned Patent Literature 1.

FIG. 1 is a schematic view in which a rotary hearth furnace 1 is observed from above. In FIG. 1, a means 2 for supplying an agglomerate onto a hearth of the rotary hearth furnace 1, a means 3 for discharging heated substances which have been heated in the rotary hearth furnace 1 to the outside of the furnace, and a means 4 for discharging exhaust gas in the rotary hearth furnace 1 to the outside of the furnace are projected and depicted on the hearth in order to explain the positional relationship among the means 2 to 4. In an actual machine, the means 2 for supplying an agglomerate onto the hearth of the rotary hearth furnace 1 and the means 4 for discharging exhaust gas in the rotary hearth furnace 1 to the outside of the furnace are provided on the ceiling of the rotary hearth furnace 1, and the means 3 for discharging heated substances which have been heated in the rotary hearth furnace 1 to the outside of the furnace is provided near the hearth of the rotary hearth furnace 1. A supply machine may be, for example, used as the means 2 for supplying an agglomerate onto the hearth of the rotary hearth furnace 1. A discharge machine may be, for example, used as the means 3 for discharging heated substances which have been heated in the rotary hearth furnace 1 to the outside of the furnace. An exhaust port may be, for example, provided as the means 4 for discharging exhaust gas in the rotary hearth furnace 1 to the outside of the furnace.

An arrow 10 shown by the solid line in FIG. 1 designates the moving direction of the agglomerate on the hearth, the agglomerate being supplied from the means 2 for supplying an agglomerate onto the hearth of the rotary hearth furnace 1. An arrow 11*a* shown by the rough broken line and an arrow 11*b* shown by the fine broken line designate the flow directions of exhaust gas inside the rotary hearth furnace 1.

In FIG. 1, a partition wall 5*a* is provided on the downstream side of the means 2 for supplying an agglomerate onto the hearth of the rotary hearth furnace 1 and on the upstream side of the means 4 for discharging exhaust gas in the rotary hearth furnace 1 to the outside of the furnace. In addition, a partition wall 5*b* and a partition wall 5*c* are provided on the downstream side of the means 4 for discharging exhaust gas in the rotary hearth furnace 1 to the outside of the furnace, and between the means 4 for discharging exhaust gas in the rotary hearth furnace 1 to the outside of the furnace and the means 3 for discharging heated substances which have been heated in the rotary hearth furnace 1 to the outside of the furnace.

Z1 shown in FIG. 1 represents a heating section, and Z2 shown therein represents a non-heating section. Although not shown, a heating burner is provided in the heating section Z1.

In the configuration example illustrated in FIG. 1, the means 4 for discharging exhaust gas in the rotary hearth furnace 1 to the outside of the furnace is provided in the heating section Z1. The means 2 for supplying an agglomerate onto the hearth of the rotary hearth furnace 1 and the means 3 for discharging heated substances which have been heated in the rotary hearth furnace 1 to the outside of the furnace are provided in the non-heating section Z2.

As illustrated in FIG. 1, the agglomerate supplied from the means 2 for supplying an agglomerate onto the hearth of the rotary hearth furnace 1 moves counterclockwise along the arrow 10 inside the furnace, and is heated in the heating section Z1. Thus, iron oxide is reduced to obtain reduced iron. The reduction of iron oxide is completed before reaching the partition wall 5*b*. After the completion of the reduction, heated substances are cooled in the non-heating section Z2, and discharged to the outside of the furnace by using the means 3 for discharging heated substances which have been heated in the rotary hearth furnace 1 to the outside of the furnace. A cooler may be, for example, provided between the partition wall 5*b* and the partition wall 5*c*.

In the heating section Z1, the heating burner is burnt to heat the agglomerate. On this occasion, exhaust gas is generated. Exhaust gas generated in the furnace moves toward the means 4 for discharging exhaust gas in the rotary hearth furnace 1 to the outside of the furnace. That is, the exhaust gas generated in the rotary hearth furnace 1 branches at a branching position 6 in the middle of the furnace, and it branches and moves in the clockwise direction of the arrow 11*a* and the counterclockwise direction of the arrow 11*b* in accordance with the balance between the volume of the exhaust gas generated in the rotary hearth furnace 1 and the pressure in the rotary hearth furnace 1.

On this occasion, when the means 4 for discharging exhaust gas to the outside of the furnace is provided in the heating section Z1 as illustrated in FIG. 1, the heating burner has to be burnt to heat the room-temperature agglomerate charged onto the hearth in a section Z1*a* between the partition wall 5*a* and the means 4 for discharging exhaust gas to the outside of the furnace. In addition, since the moving direction 10 of the agglomerate coincides with the flow direction 11*b* of the exhaust gas inside the furnace, the efficiency of heating due to gas heat transfer is lowered. Further, when the branching position 6 of the exhaust gas is located at a final stage of the heating section Z1 as illustrated in FIG. 1, the moving direction 10 of the agglomerate and the flow direction 11*b* of the exhaust gas inside the furnace coincide with each other in a section Z1*b* between the branching position 6 of the exhaust gas and the partition wall 5*b*. Thus, the efficiency of heating due to gas heat transfer is lowered.

Therefore, the present inventor has made in-depth examinations in order to oppose the moving direction 10 of the agglomerate to the flow direction 11*a* of the exhaust gas inside the furnace even in the section Z1*a* and the section Z1*b* of the heating section Z1 illustrated in FIG. 1. As a result, it has been proved that it will go well if the means 4 for discharging exhaust gas in the rotary hearth furnace 1 to the outside of the furnace is provided in the non-heating section Z2, and a means for taking outside air from the outside of the furnace into the furnace is provided in the non-heating section Z2 and on the upstream side of the means 4 for discharging exhaust gas to the outside of the furnace. A configuration example of a rotary-heath furnace 1 according to an embodiment of the present invention will be described with reference to FIG. 2. For the same parts as those in FIG. 1, the same references are used and redundant description will be thereby avoided.

Figure 2:
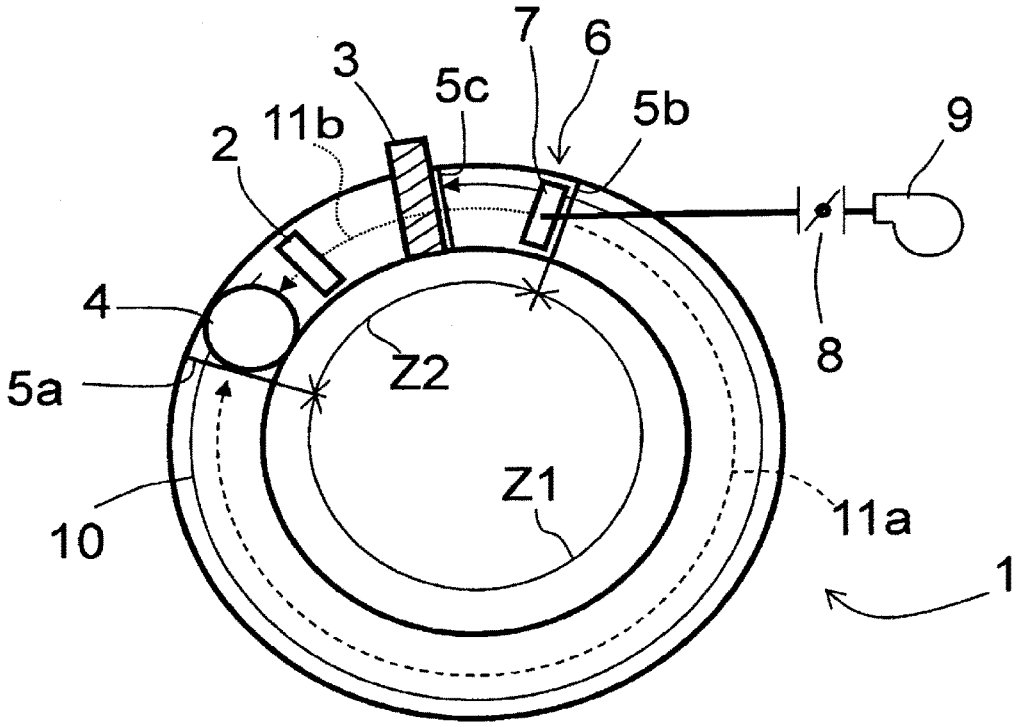
FIG. 2 is a schematic view for explaining a rotary hearth furnace according to an embodiment of the present invention.

In FIG. 2, the means 4 for discharging exhaust gas in the rotary hearth furnace 1 to the outside of the furnace is provided in the non-heating section Z2. Further, a means 7 for taking outside air into the furnace is provided in the non-heating section Z2 and on the upstream side of the means 4 for discharging exhaust gas to the outside of the furnace.

When the means 4 for discharging exhaust gas in the rotary hearth furnace 1 to the outside of the furnace is provided in the non-heating section Z2 as illustrated in FIG. 2, the section Z1*a* illustrated in FIG. 1 can be prevented from being formed. That is, in FIG. 1, the moving direction 10 of the agglomerate and the flow direction 11*a* of the exhaust gas in the furnace coincide with each other in the section Z1*a* of the heating section Z1 because the means 4 for discharging exhaust gas to the outside of the furnace is provided in the heating section Z1. On the other hand, according to the embodiment, the means 4 for discharging exhaust gas to the outside of the furnace is provided in the non-heating section Z2 as illustrated in FIG. 2. Thus, the moving direction 10 of the agglomerate and the flow direction 11*a* of the exhaust gas in the furnace can be opposed to each other even in a part corresponding to the section Z1*a* illustrated in FIG. 1 of the heating section Z1. As a result, the agglomerate can be heated by the sensible heat of the exhaust gas. The exhaust gas deprived of the sensible heat is discharged to the outside of the furnace through the means 4 for discharging exhaust gas to the outside of the furnace. In this manner, according to the present invention, exhaust gas whose temperature is high because it has not been in contact with the agglomerate can be prevented from being discharged to the outside of the furnace as it is. Thus, the sensible heat of the exhaust gas can be used effectively. In addition, when the sensible heat of the exhaust gas is used effectively, the combustion amount of the heating burner disposed in the heating section Z1, particularly on the upstream side thereof, can be reduced in comparison with that in a conventional one. In addition, when the moving direction 10 of the agglomerate is opposed to the flow direction 11*b* of the exhaust gas inside the furnace, the efficiency of heating due to gas heat transfer can be increased. In this manner, according to the configuration example illustrated in FIG. 2, the productivity of reduced iron can be improved.

In addition, as illustrated in FIG. 2, when the means 7 for taking outside air into the furnace is provided in the non-heating section Z2 and on the upstream side in the exhaust gas flow direction from the means 4 for discharging exhaust gas to the outside of the furnace, the section Z1*b* illustrated in FIG. 1 can be prevented from being formed. That is, in FIG. 1, the flow direction of the exhaust gas branches in accordance with the balance between the volume of the exhaust gas generated in the rotary hearth furnace 1 and the pressure in the rotary hearth furnace 1. As a result, the section Z1*b* where the moving direction 10 of the agglomerate and the flow direction 11*b* of the exhaust gas coincide with each other is formed. On the other hand, according to the present invention, as illustrated in FIG. 2, the means 7 for taking outside air into the furnace is provided in the non-heating section Z2 and on the upstream side in the exhaust gas flow direction from the means 4 for discharging exhaust gas to the outside of the furnace. When the means 7 for taking outside air into the furnace is provided, outside air can be taken from the outside of the furnace in consideration of the amount of outside air taken from the means 2 for supplying an agglomerate onto the hearth of the rotary hearth furnace 1 and the means 3 for discharging heated substances which have been heated in the rotary hearth furnace 1 to the outside of the furnace, and the pressure in the furnace. This outside air is made to flow in the direction of the arrow 11*b* so that the exhaust gas generated in the heating section Z1 inside the furnace can be prevented from flowing in the direction of the arrow 11*b*, and can be made to flow in the direction of the arrow 11*a*. As a result, in the heating section Z1, the moving direction 10 of the agglomerate can be opposed to the flow direction 11*a* of the exhaust gas inside the furnace. In addition, when outside air is taken from the outside of the furnace into the furnace and this outside air is made to flow into the non-heating section Z2, the heated substances that have moved from the heating section Z1 to the non-heating section Z2 can be cooled. On this occasion, the load of the cooler provided in the non-heating section Z2 in accordance with necessity can be reduced.

When outside air is taken from the outside of the furnace into the furnace, there is a fear that the volume of exhaust gas discharged from the rotary hearth furnace 1 may be increased. However, exhaust gas discharged from the rotary hearth furnace 1 is diluted by using the air conventionally in order to reduce the temperature of the exhaust gas. Therefore, even when outside air is taken from the outside of the furnace into the furnace as in the present invention, the volume of exhaust gas discharged from the rotary hearth furnace 1 is not increased too much.

As the outside air to be taken from the outside of the furnace, exhaust gas from the cooler or another device used in the rotary hearth furnace or in a cooling step may be used as well as outside air existing outside of the furnace. That is, exhaust gas including combustion gas or inert gas discharged from the rotary hearth furnace and so on may be taken into the rotary hearth furnace as the outside air.

Although FIG. 2 illustrates a configuration example in which the means 4 for discharging exhaust gas in the rotary hearth furnace 1 to the outside of the furnace is provided between the means 2 for supplying an agglomerate onto the hearth of the rotary hearth furnace 1 and the partition wall 5*a*, the rotary hearth furnace 1 according to the present invention is not limited to the configuration example. For example, the means 4 for discharging exhaust gas in the rotary hearth furnace 1 to the outside of the furnace may be provided between the means 3 for discharging heated substances which have been heated in the rotary hearth furnace 1 to the outside of the furnace and the means 2 for supplying an agglomerate onto the hearth of the rotary hearth furnace 1. Or the means 4 for discharging exhaust gas in the rotary hearth furnace 1 to the outside of the furnace may be provided between the partition wall 5*c* and the means 3 for discharging heated substances which have been heated in the rotary hearth furnace 1 to the outside of the furnace. Alternatively, the means 4 for discharging exhaust gas in the rotary hearth furnace 1 to the outside of the furnace may be provided between the means 7 for taking outside air into the furnace and the partition wall 5*c*.

In addition, although FIG. 2 illustrates a configuration example in which the means 7 for taking outside air into the furnace is provided between the partition wall 5*b* and the partition wall 5*c*, the rotary hearth furnace 1 according to the present invention is not limited to the configuration example. For example, the means 7 for taking outside air into the furnace may be provided between the partition wall 5*c* and the means 3 for discharging heated substances which have been heated in the rotary hearth furnace 1 to the outside of the furnace. Or the means 7 for taking outside air into the furnace may be provided between the means 3 for discharging heated substances which have been heated in the rotary hearth furnace 1 to the outside of the furnace and the means 2 for supplying an agglomerate onto the hearth of the rotary hearth furnace 1. Alternatively, the means 7 for taking outside air into the furnace may be provided between the means 2 for supplying an agglomerate onto the hearth of the rotary hearth furnace 1 and the means 4 for discharging exhaust gas in the rotary hearth furnace 1 to the outside of the furnace. It is preferable that the means 7 for taking outside air into the furnace is provided in the uppermost stream position of the non-heating section Z2 as illustrated in FIG. 2, so that the outside air taken into the furnace can also serve as a coolant for the heated substances fed from the heating section Z1 to the non-heating section Z2.

It is preferable that the means 7 for taking outside air into the furnace is provided with an regulating valve 8 capable of regulating the volume of gas taken in. Operation in the rotary hearth furnace 1 is normally performed under a decompression condition. Therefore, outside air can be taken into the furnace only if an opening is provided in the wall or ceiling of the furnace as the means 7 for taking outside air into the furnace. However, when the regulating valve 8 is further provided, the volume of outside air taken into the furnace can be regulated in accordance with the volume of gas generated in the rotary hearth furnace 1 or the pressure in the furnace.

In addition, the means 7 for taking outside air into the furnace may be provided with a blower 9. When the blower is provided, outside air outside the furnace can be taken into the furnace positively in accordance with necessity.

Although FIG. 2 illustrates a configuration example in which the partition walls 5*a* to 5*c* are provided, the rotary hearth furnace 1 according to the present invention is not limited to the configuration example. Such partition walls may not be provided.

The rotary hearth furnace 1 is used for heating an agglomerate including an iron-oxide containing material and a carbonaceous reducing material and reducing iron oxide to thereby produce reduced iron. As the iron-oxide containing material, specifically, use can be made of iron-oxide containing materials such as iron ore, iron sand, iron-making dust, residues of nonferrous metal refining, iron-making wastes, etc. As the carbonaceous reducing material, use can be made of, for example, coal, coke, etc.

At least one kind selected from the group consisting of melting point adjusters and binders may be further formulated in the mixture including the iron-oxide containing material and the carbonaceous reducing material.

The aforementioned melting point adjusters mean materials having an action of decreasing the melting point of gangue in the iron-oxide containing material or ash in the carbonaceous reducing material. That is, when such a melting point adjuster is formulated in the aforementioned mixture, it is possible to give influence to the melting point of another component (particularly gangue) than iron oxide included in the agglomerate, so that the melting point thereof can be, for example, decreased. As a result, melting of the gangue is promoted to form molten slag. On this occasion, a part of iron oxide dissolves in the molten slag so that it can be reduced into metal iron in the molten slag. Coming into contact with metal iron reduced in a solid state, the metal iron produced in the molten slag is flocculated as solid reduced iron.

As the melting point adjustors, use can be made of, for example, a CaO supplying material, an MgO supplying material, an Al2O3 supplying material, an SiO2 supplying material, etc. As the CaO supplying material, for example, at least one selected from the group consisting of CaO (quick lime), Ca(OH)2 (slaked lime), CaCO3 (limestone), and CaMg(CO3)2 (dolomite) may be used. As the MgO supplying material, for example, at least one selected from the group consisting of MgO powder, an Mg containing material extracted from natural ore, sea water, etc., and MgCO3 may be compounded. As the Al2O3 supplying material, for example, Al2O3 powder, bauxite, boehmite, gibbsite, diaspore, etc. may be compounded. As the SiO2 supplying material, for example, SiO2 power, silica sand, etc. may be used.

As the binders, use can be made of, for example, polysaccharides such as starch typified by cornstarch, flour, etc.

A rotary vessel type mixer or a fixed vessel type mixer may be used for mixing raw materials. Examples of the form of the rotary vessel type mixer may include a rotary cylindrical shape, a double conical shape, a V-shape, etc., though not limited especially. Examples of the form of the fixed vessel type mixer may include one having a rotary vane such as a plow provided in a mixing vessel. However, the form is not limited especially.

As an agglomerating machine for agglomerating the mixture, use can be made of, for example, a pan type pelletizer (disk type pelletizer), a cylindrical pelletizer (drum type pelletizer), a twin roll type briquette molding machine, etc.

The shape of the agglomerate is not limited especially. Molding thereof may be performed by any one of pelletizing, briquette molding, or extrusion.

It is preferable that the agglomerate is heated and reduced at not lower than 1,300° C. and not higher than 1,500° C. When the heating temperature is below 1,300° C., metal iron or slag is hardly melted, and high productivity cannot be obtained. On the contrary, when the heating temperature is beyond 1,500° C., the temperature of exhaust gas is so high that exhaust gas treatment equipment becomes large in scale to increase the equipment cost.

The present invention is not limited to the aforementioned embodiment, but suitable combinations of elements of the embodiment or various changes may be made thereon without departing from the gist thereof. Particularly, in the embodiment disclosed herein, not values deviating from ranges with which those skilled in the art use normally but values that can be estimated easily by those normally skilled in the art are used as items that are not disclosed expressly, for example, operating conditions, measuring conditions, various parameters, dimensions, weights and volumes of constituents, etc.

The present application is based on a Japanese patent application filed on Jul. 16, 2014 (Application No. 2014-146141), the contents thereof being incorporated herein by reference.

DESCRIPTION OF REFERENCE NUMERALS AND SIGNS

1 rotary hearth furnace
2 means for supplying onto the hearth
3 means for discharging heated substances which have been heated in the rotary hearth furnace 1 to the outside of the furnace
4 means for discharging exhaust gas in the rotary hearth furnace 1 to the outside of the furnace
5*a* to 5*c* partition wall
6 branching position of exhaust gas
7 means for taking outside air into the furnace
8 regulating valve
9 blower
10 moving direction of the agglomerate
11*a*, 11*b* flow direction of exhaust gas inside the furnace
Z1, Z1*a*, Z1*b* heating section
Z2 non-heating section

The invention claimed is:

1. A rotary hearth furnace for heating an agglomerate comprising an iron-oxide containing material and a carbonaceous reducing material to produce a reduced iron, the rotary hearth furnace having a heating section and a non-heating section and comprising:

a unit that supplies the agglomerate onto a hearth of the rotary hearth furnace;

a unit that discharges a heated substance which has been heated in the rotary hearth furnace to the outside of the furnace;

a unit that discharges an exhaust gas in the rotary hearth furnace to the outside of the furnace; and a unit that takes an outside air into the furnace, wherein:

the unit that discharges the exhaust gas to the outside of the furnace is provided in the non-heating section; and the unit that takes an outside air into the furnace is provided in the non-heating section and on an upstream side in a flow direction of the exhaust gas from the unit that discharges the exhaust gas to the outside of the furnace.

2. The rotary hearth furnace according to claim 1, wherein the unit that takes the outside air into the furnace comprises a regulating valve that regulates the volume of a gas taken in.

3. The rotary hearth furnace according to claim 1, wherein the unit that takes the outside air into the furnace comprises a blower.

4. The rotary hearth furnace according to claim 2, wherein the unit that takes the outside air into the furnace comprises a blower.

5. The rotary hearth furnace according to claim 1, further comprising a partition wall that partitions the heating section and the non-heating section.

6. The rotary hearth furnace according to claim 2, further comprising a partition wall that partitions the heating section and the non-heating section.

7. The rotary hearth furnace according to claim further comprising a partition wall that partitions the heating section and the non-heating section.

8. The rotary hearth furnace according to claim 4, further comprising a partition wall that partitions the heating section and the non-heating section.

* * * * *